US005383801A

United States Patent [19]

Chas

[11] Patent Number: 5,383,801

[45] Date of Patent: Jan. 24, 1995

[54] HOLLOW JET THRUSTER DEVICE

[76] Inventor: Jean-Bernard Chas, Villa des Haules, 76790 Etretat, France

[21] Appl. No.: 78,305

[22] PCT Filed: Jan. 2, 1992

[86] PCT No.: PCT/FR92/00001

§ 371 Date: Jan. 18, 1993

§ 102(e) Date: Jan. 18, 1993

[87] PCT Pub. No.: WO92/12048

PCT Pub. Date: Jul. 23, 1992

[30] Foreign Application Priority Data

Jan. 2, 1991 [FR] France ..... 91 00022

[51] Int. Cl.[6] ..... B63H 21/12

[52] U.S. Cl. ..... 440/5; 440/38

[58] Field of Search ..... 440/5, 6, 38, 47, 89, 440/46, 66, 67; 60/221, 226 R

[56] References Cited

U.S. PATENT DOCUMENTS

| | | | |
|---|---|---|---|
| 3,587,511 | 6/1971 | Buddrus | 440/5 |
| 4,023,353 | 5/1977 | Hall | 440/38 |
| 4,680,017 | 7/1987 | Eller | 440/72 |
| 4,897,995 | 2/1990 | Guirguis | 60/221 |
| 4,929,200 | 5/1990 | Guezou et al. | 440/38 |

FOREIGN PATENT DOCUMENTS

| | | |
|---|---|---|
| 2286961 | 4/1976 | France . |
| 2416162 | 8/1979 | France . |
| 1323871 | 7/1973 | United Kingdom . |

*Primary Examiner*—Ed Swinehart

*Attorney, Agent, or Firm*—Griffin Butler Whisenhunt & Kurtossy

[57] ABSTRACT

A device for producing thrust from a flow of accelerated fluid, including: a fluid accelerator (1) fitted with drive vanes (5) and rotated inside a stator (10) about an axis of revolution; a circularly symmetrical stationary web portion (7) centered on the axis and having a plurality of fins (8) shaped to rectify the trajectory of fluid coming from the accelerator in order to form a hollow jet (9) with a volume of space within the hollow jet; and ducts (17) for supplying pressure to the volume of space within the hollow jet (9). The invention relates to an improvement where drive members (12) for the accelerator (1) are disposed in the volume of space within the hollow jet (9).

7 Claims, 1 Drawing Sheet

HOLLOW JET THRUSTER DEVICE

The present invention relates to devices designed to produce thrust from a flow of fluid accelerated to form a hollow jet whose inside space is fed with pressure.

BACKGROUND OF THE INVENTION

Such devices are illustrated in particular, by Document EP 270 544, which corresonds to U.S. Pat. No. 4,902,254. Such devices possess high thrust efficiency and also offer the possibility of placing all of the rotor drive mechanisms in the space available behind the turbine inside the hollow portion of the thrust jet.

SUMMARY OF THE INVENTION

The invention thus provides an improvement to a device for producing thrust from a flow of accelerated fluid; said device including: fluid acceleration means fitted with drive vanes and rotated inside a stator about an axis of revolution; a circularly symmetrical stationary web portion centered on the axis and comprising a plurality of fins shaped to rectify the trajectory of the fluid coming from the acceleration means in order to form a hollow jet; and means for feeding pressure to the space inside said hollow jet. The improvement lies in the fact that the drive members for the acceleration means are housed in the inside volume of the hollow jet. One of the advantages of this disposition is that it enables the suction orifice to be disengaged, thereby making it possible to provide a proper fairing for the entire turbine portion (rotor and stator), thereby making it possible to avoid producing parasitic hydrodynamic noise. In addition, since the amount of space available at the rear of the thruster device is large, it is possible to accept rotor drive mechanisms that are voluminous and of various shapes, regardless of whether they make use of a drive shaft and gearing, an electric motor, or a hydraulic motor.

These drive members are supported by an arm that passes through the jet-forming tubular wall by means of a streamlined section that serves to minimize the disturbance to the jet as caused by the arm.

The drive member support arm may also constitute the support for the stator of the device.

Advantageously, the arm may include an element that is substantially perpendicular to the axis of rotation of the rotor, and that is rotatably and steerably mounted in a bearing secured to a vehicle that is propelled by the thruster device.

Advantageously, the arm constitutes the fairing for all of the electrical or fluid connections used for powering the rotor drive members and also for one or more ducts for feeding the space inside the hollow jet with a gas under pressure.

Finally, the arm may constitute the support of a grille or "strainer" in front of the thruster device.

BRIEF DESCRIPTION OF THE DRAWINGS

Other characteristics and advantages appear from the following description of an embodiment of the invention given by way of example and made with reference to the accompanying drawing, in which.

DESCRIPTION OF EMBODIMENTS

Figure 1:
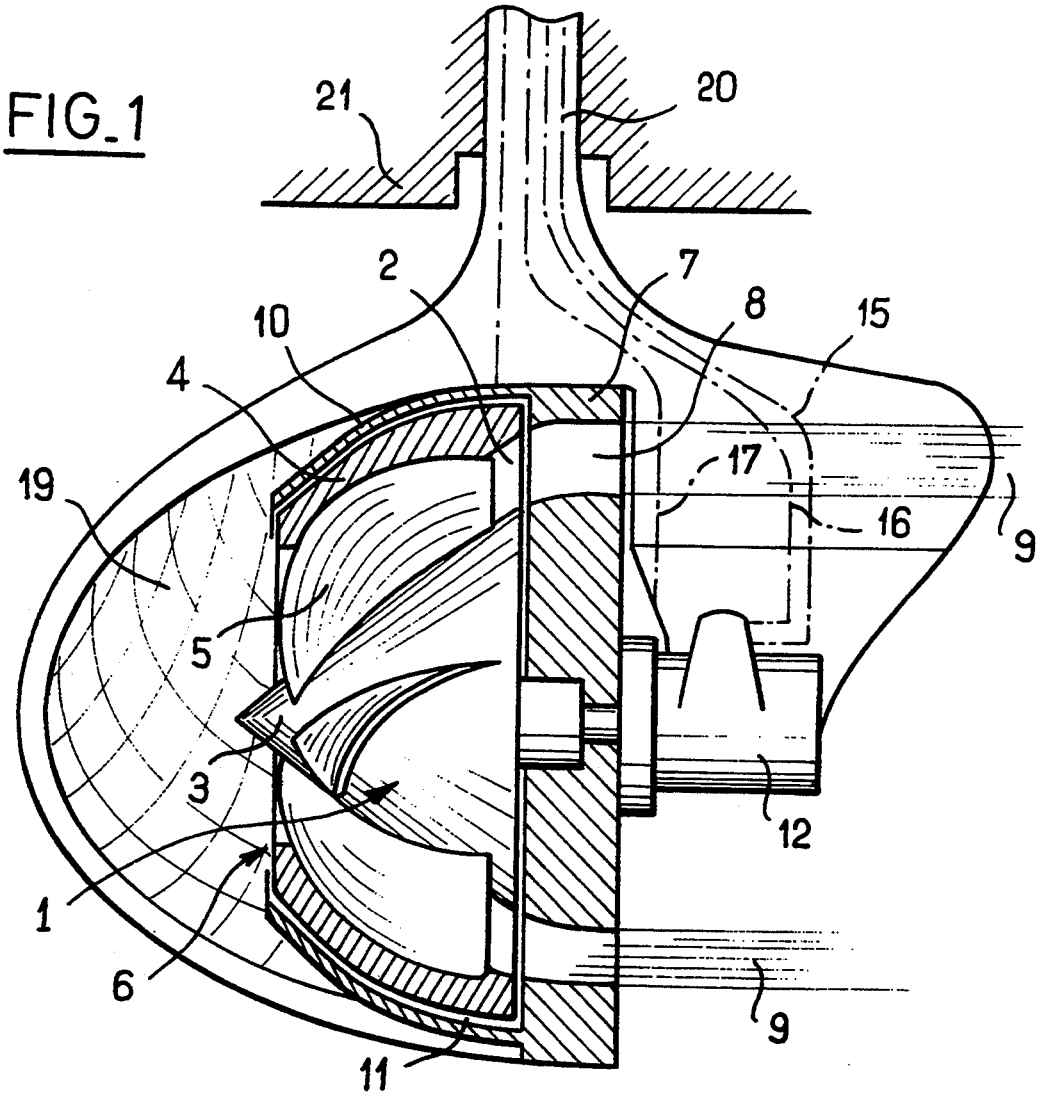
FIG. 1 is a section view through a thruster device fitted with the improvement of the invention.

In conventional manner, the thruster carries a first water-acceleration stage constituted by a rotor 1 essentially comprising a frustoconical annular passage 2 formed between a central nose 3 and an outer rotor wall 4, said frustoconical conical annular passage being fitted with vanes 5 for accelerating the water passing through said passage from the thruster inlet 6 to a web portion 7 having stationary fins 8 that shape the outlet jet into a tubular and rectilinear jet 9.

The stationary web portion 7 is secured to a stator 10 in which the rotor 1 is rotatably mounted and is supported by a hydrodynamic cushion 11 that may be implemented between the stator 10 and the tubular wall 4 of the rotor.

Figure 2:
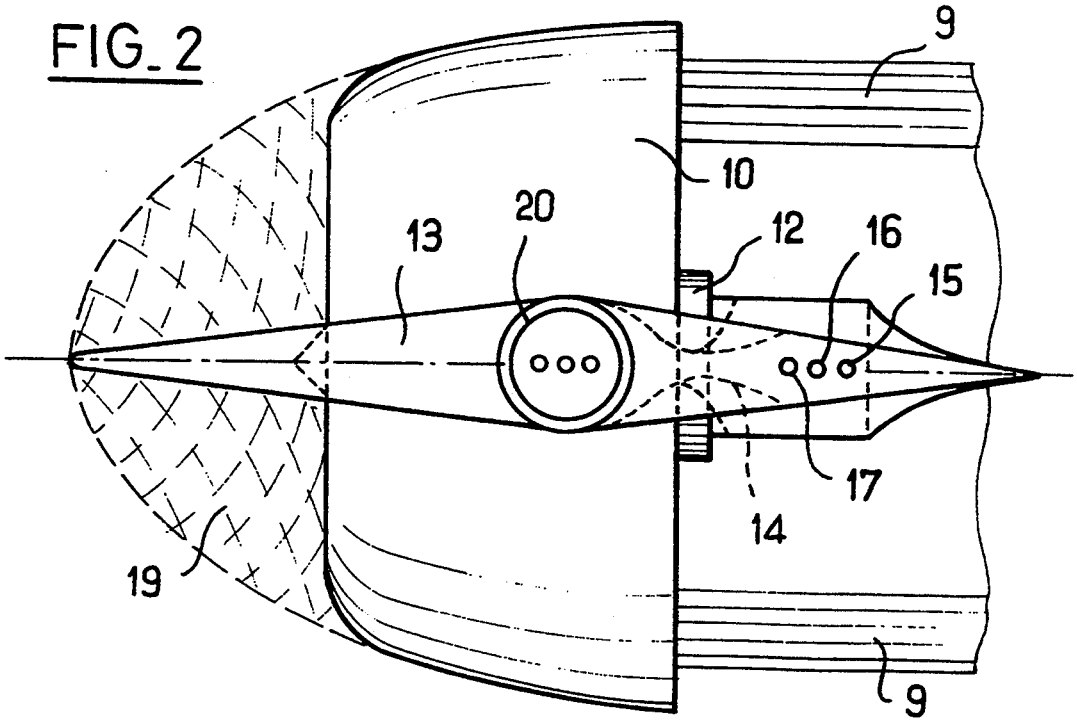
FIG. 2 is a diagrammatic plan view of said device.

The rotor 1 is driven by drive means 12 represented in this case as a hydraulic motor. The stator, the stationary web portion, and the motor 12 are supported by a support arm 13, and in FIG. 2 it can be seen that the support arm 13 is streamlined so as to minimize its resistance to forward motion through the water. In addition, said arm 13 penetrating into the tubular jet 9 has a zone 14 where it passes through the tubular jet that is streamlined to limit the disturbances set up in the jet by the presence of the arm. The unwanted effect of such disturbances at the web portion 7 can be reduced by providing fins 8 that serve to deflect the rectified liquid streams so that the fins 8 perform the function described in the document mentioned in the introduction. thereby causing said streams to be as tangential as possible to the streamlined surface of zone 14.

When the motor 12 is a hydraulic motor, the arm 13 includes ducts 15 and 16 for feeding pressurized fluid to the motor and for returning low pressure fluid to a tank. It also includes a passage for a duct 17 that feeds the inside space of the tubular jet 9 with pressure, and a duct (not shown) for feeding the hydrodynamic cushion 11 between the stator 10 and the wall of the rotor wall 4.

The motor 12 has an outlet shaft passing through the stationary web portion 7 to be coupled to the central nose 3 of the rotor.

The motor 12 may be an electric motor, in which case the ducts 15 and 16 serve to feed electrical power. In a variant, not shown, it is also possible to imagine that the drive means serve not only to drive the rotor, but also, e.g. by means of an auxiliary motor and suitable rodding and gearing, to change the angles of attack presented by the vanes 5 so as to cause the flow rate or the acceleration of the fluid passing through the turbine to vary. Sufficient space is available inside the hollow jet 9 to accommodate various drive members or devices for driving the various portions of the thruster without penalizing the efficiency thereof.

Finally, it may be observed that the arm 13 has a leading nose that is also streamlined and that constitutes a support for a protective grille 19 that protects the inlet 6 to the thruster.

Finally, the support arm 13 constitutes the end of a tubular element 20 that extends substantially perpendicular to the axis of revolution of the rotor, and that is pivotally mounted in a bearing secured to the structure 21 of the vehicle to which the thruster is coupled. The length of the bearing surface in the bearing is calculated so as to ensure good transmission of forces via said element 20 of the support, with the relative angle between the thruster and the structure 21 of the vehicle being variable for the purpose of steering the vehicle.

Mention may also be made of the possibility (not shown) for the device of the invention to be fitted with deflector or rudder surfaces in the jet also serving to steer the vehicle, with the inclination of such deflector surfaces relative to the jet being controllable by drive members, for example, likewise placed behind the thruster in the inside space of the hollow jet 9.

I claim:

1. In a device for producing thrust from a flow of accelerated fluid comprising a stator (10), a fluid acceleration means (1) having drive vanes (5) and being rotatable inside the stator (10) about an axis of revolution by drive members, a circularly symmetrical stationary web portion (7) centered on said axis and having a plurality of fins (8) configured to rectify a trajectory of the fluid passing from the accelerator means (1) so as to form a hollow jet (9) having a volume of space inside the hollow jet, and means for supplying pressure to said volume of space, the improvement wherein the drive members (12) for the acceleration means (1) are disposed within the volume of space inside the hollow jet.

2. An improvement according to claim 1, wherein the drive members are supported by an arm that is streamlined at least in a zone passing through the jet.

3. An improvement according to claim 2, wherein the arm constitutes the support for the stator.

4. An improvement according to claim 2, wherein the arm includes an element that is substantially perpendicular to the axis of rotation, which element is rotatably and steerably mounted in a bearing secured to a vehicle that is propelled by the device.

5. An improvement according to claim 1, wherein the drive members include a hydraulic motor having a feed duct and exhaust duct which are contained in the arm.

6. An improvement according to claim 1, wherein the arm includes means for supplying the volume of space with pressure.

7. An improvement according to claim 1, wherein the arm includes a front portion for supporting a grill for water admitted into an inlet of the device.

* * * * *